United States Patent [19]

Fracker

[11] 3,954,076

[45] May 4, 1976

[54] REINFORCING PATCH FOR SAILS AND METHOD OF MAKING SAME

[76] Inventor: Edward P. Fracker, 356 Cornwall, Rocky River, Ohio 44116

[22] Filed: Mar. 3, 1975

[21] Appl. No.: 554,443

[52] U.S. Cl. ..... 114/103

[51] Int. Cl.[2] ..... B63H 9/06

[58] Field of Search ..... 114/102, 103, 111, 114, 114/115, 39

[56] References Cited

UNITED STATES PATENTS

| | | | |
|---|---|---|---|
| 2,499,598 | 3/1950 | Maurer et al. | 114/103 |
| 2,589,203 | 3/1952 | Nilsen | 114/103 |
| 3,274,968 | 9/1966 | Hayes et al. | 114/103 |

FOREIGN PATENTS OR APPLICATIONS

| | | | |
|---|---|---|---|
| 563,913 | 6/1957 | Italy | 114/103 |

*Primary Examiner*—Trygve M. Blix
*Assistant Examiner*—Stuart M. Goldstein
*Attorney, Agent, or Firm*—Albert L. Ely, Jr.

[57] ABSTRACT

Reinforcing patch for corners of sails, particularly clews and tacks, comprised of substantially rectangular patch panels fanned outwardly from the grommets at the corners of a sail, the outer edges of the patch panels defining chords of a substantially circular arc centered on the point of strain at the sail corner. Patch formed by sewing overlapping edges of the formed patch panels to each other and the panel or panels of the sail's corner reinforced thereby.

10 Claims, 4 Drawing Figures

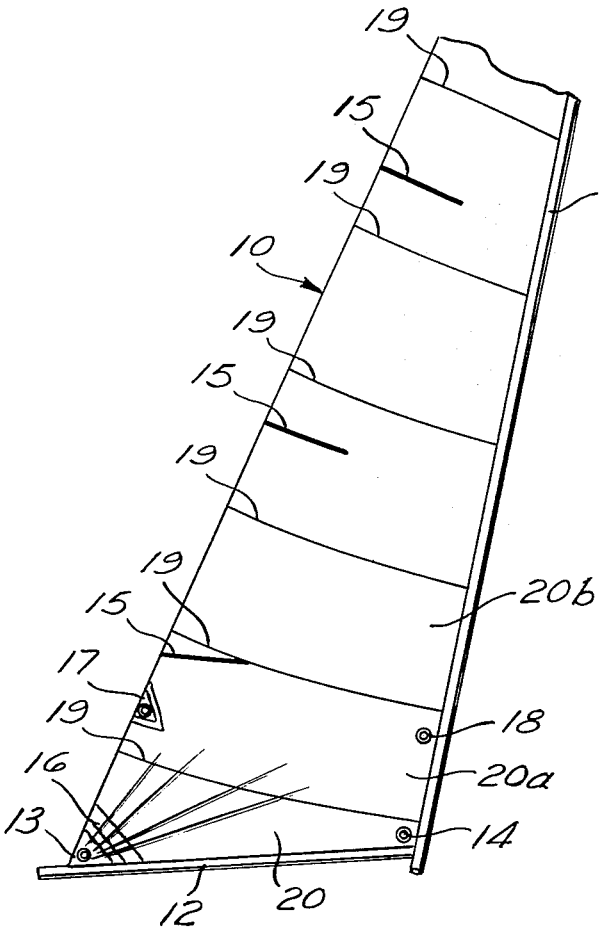
Fig. 1
Fig. 2
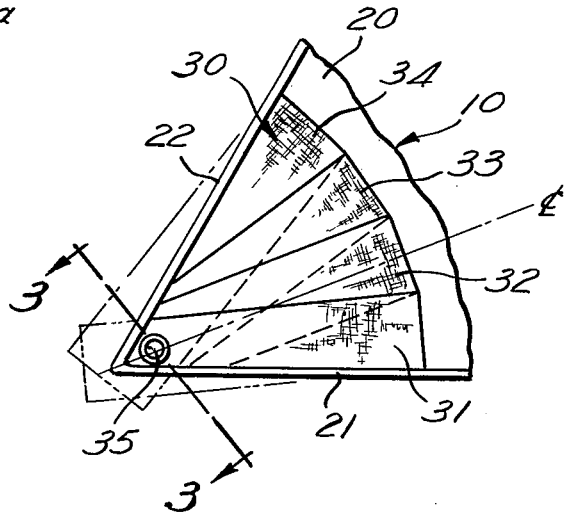
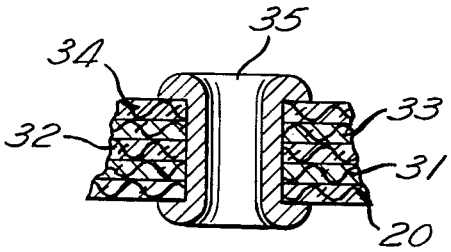
Fig. 3
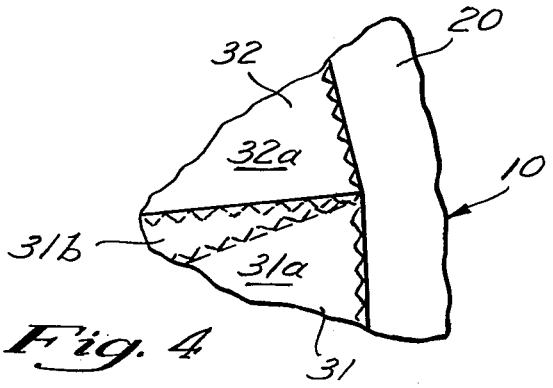
Fig. 4

REINFORCING PATCH FOR SAILS AND METHOD OF MAKING SAME

This invention relates to means for reinforcing the corners of a sail, and more particularly the clews and tacks where the concentrations of strains might otherwise not only overload the un-reinforced sailcloth at and around the grommets located at such corners but also cause deep wrinkles radiating therefrom; which interfere with and at least partially destroy the smooth aerodynamic contours desired for the sails. Such contours are, in theory, built into sails by the sailmaker's curvatures in the luffs, leeches, and feet and/or the seams joining the panels of sailcloth from which the sails are made. This invention also relates to the method of building such improved reinforcements, generally referred to as "patches", into the sails at a substantial saving of labor and/or material.

Heretofore, various configurations of patches, especially at the clews, have been employed to overcome the strains at the corners of a sail. Such patches effectively add more plies of sailcloth, as the un-reinforced panel approaches the clew, for example; by sewing the edges of the plies to each other and the sail panel, the clew is reinforced in increments intended to distribute the strain over a larger area of the panel.

The most common and preferred of such prior art clew reinforcements, particularly in fore-and-aft sails which have no miter extending to the clew, comprises a series of similar triangles, having successively larger bases, but sewn together and to the sail panel at their apices located at the clew and along their overlying sides. In such a patch construction, the bases of the triangular plies are parallel and the patch is completed by sewing across each base through any underlying ply and to the said panel being reinforced. To be effective and avoid bias stretch and distortion, the "run-of-goods" in each such triangular patch ply should be parallel to that of the other plies and the said panel being reinforced. Unfortunately, while the sailmaker may have on hand some larger scraps of sailcloth from which such triangular patches having the proper run of goods may be cut, he usually ends up by having to cut others from a bolt of sailcloth, increasing the amount of unusable scraps of expensive material and/or losing the time of expensive skilled labor looking for and attempting to salvage triangular plies for the patches from larger scraps. Further, the above-described triangular patches are relatively ineffective in eliminating the wrinkles, radiating from the center of strain, that at least partly spoil the intended aerodynamic contours of the sails as well as their appearance.

An object and advantage of this invention is to provide a reinforcement for the corner of a sail which minimizes loss of material and labor in building the sail. Another and unexpected advantage of a reinforcement made according to this invention is that it eliminates or substantially minimizes the contour- and appearance-spoiling wrinkles radiating from the area of maximum strain.

Other objects and advantages of this invention will be apparent from the following specification, claims, and drawings, in which:

FIG. 1 is an elevation, broken away at the head, of a mainsail hoisted on a mast and out-hauled on the boom; it shows the above-described conventional and prior art triangular multiply clew reinforcement.

FIG. 2 is a fragmentary elevation constituting an enlarged detail of a reinforced clew made according to this invention and also showing, in dash construction lines, portions of some of such patch panels which are cut away when forming the tabling for the leech and foot.

FIG. 3 is a cross-section along the line 3—3 of FIG. 2, axially exaggerated to facilitate the showing of the plies clinched together by the heavy grommet at the clew.

FIG. 4 is another enlarged detail showing the seaming at the outer ends of a pair of patch panels so as to join them to each other and the said panel which they reinforce.

Referring to FIG. 1 of the drawings, it shows a conventional high-aspect mainsail 10 hoisted on a mast 11 and out-hauled on the boom 12 by means of out-haul gear (not shown) connected to the clew grommet 13. The tack of the mainsail 10 is secured to the forward end of the boom 12 by a conventional shackle (not shown for simplicity of illustration) connecting through the tack grommet 14. The roach in the leech is supported by conventional battens 15. The clew of the sail 10 is reinforced by a conventional multi-ply triangular clew patch 16, above which is located a similar triangular multi-ply reefing clew patch 17 having a grommet permitting the clew patch 17 to be out-hauled for "jiffy" or "slab" reefing of the sail 10; in such reefing the grommet of the "Cunningham hole" 18 serves as the tack for the reefed sail. (Reefing points intermediate the patch 17 and grommet 18 are usually provided, but are omitted as superfluous in this figure showing a conventional sail.)

As indicated by the seams 19, the sail 10 is built from panels of sail cloth 20, 20*a*, 20*b*, etc., the lowest panel 20 having its lower edge shaped to provide the desired contour at the foot, the forward edges of the panels being cut to provide the desired draft in combination with the shaping achieved by the seams 19, and the aft edges of the panels being cut to provide the desired roach in the leech. The wrinkles radiating from the clew grommet 13 under the strain on the sail 10 due to the wind load and the out-haul, despite the reinforcing patch 16, are shown in FIG. 1 and have heretofore been generally regarded as a normal and unavoidable distortion of the desired sail contour even in relatively light air, especially when the boat is relatively close-hauled for a beat or reach.

Referring to FIG. 2, a clew patch 30 is employed for the bottom panel 20 of the sail 10. This patch 30 is built up, in the particular embodiment illustrated, from four substantially congruent rectangular patch panels 31, 32, 33 and 34. The center line of each patch, indicated by cl for the patch 32, is preferably parallel to the "run-of-the-goods" (lengthwise or transversely, depending on the weave, the width of the bolt, and the length of the patch panel desired). Thus, the patch panels 31 to 34 may be cut from the bolt of sailcloth without wastage in the bolt as well as from scraps of other cuttings large enough to provide one or more substantially rectangular patch panels of the desired size.

With the four patch panels 31 to 34 stacked evenly, the panels are pinned through at one end and the other ends are fanned out so that their outer ends barely overlap while subtending the angle between the tabling (folded-over seam) in the foot and leech of the sail 10. When so arranged (see FIG. 2), the outer ends of the patch panels effectively constitute four successive chords of an arc approximately centered at the clew of the sail 10 and extending from the foot to the leech.

With the patch panels so arranged in a fanned position, it is advisable to adhere, at least temporarily, the edge of each patch panel to a patch panel which underlies it and thereafter to position and adhere the patch panels in the clew area of the sail which is to be reinforced. With the patch panels and sail thus temporarily adhered together, either before or after sewing them together, they may be drilled to receive the clew grommet 35, the ends of which are headed over to clinch all the plies at the clew together. As shown in FIG. 3, the grommet 35 thereby clinches together the sail panel 20 and, successively, the patch panels 31 to 34.

All edges of a patch panel within the clew area of the sail 10 which overlies or is overlain by another patch panel are preferably sewn through any such other patch panel and to the adjacent said panel, using the customary sailmaker's zig-zag lock-stitch, as shown in detail in FIG. 4 at the point where the outer edges of panels 31 and 32 contact. It is to be noted that all such edges are sewn together by straight seams, which allows faster machine sewing, as contrasted with sewing along a curved edge [which requires the massive amount of relatively stiff sailcloth, particularly in a large sail or sail panel, to be shifted as a curved seam (unless very gently curved) is machine-sewn.]

After the patch panel and sail panel (or panels, if the patch overlies a seam 19) have been sewn together, as above described, the outermost edges of the patch panels, 31 and 34 in this instance, and protruding ends of all patch panels are then trimmed to permit the tablings 21 and 22 to be folded over and sewn in place. Depending on whether the clinching by the grommet 35 is performed before or after sewing the tabling, the corner reinforcement is thus completed.

Why the geometry of sail corner patches made according to this invention substantially supresses the radial strain wrinkles heretofore regarded as normal is not fully understood. Referring to FIG. 4 showing the joinder of the outer ends of the patch panels 31 and 32 to each other and the sail panel 20, it is to be noted that the portion of the patch panel 31 which overlies only the sail panel 20 provides a two-ply area 31*a*, and a similar two-ply area 32*a* is provided by the patch panel 32. However, between the areas 31*a* and 32*a* there is an apex of a radially forwardly diminishing three-ply area 31*b* formed by the patch panels 31 and 32 and sail panel 20 and similar diminishing areas of at least three plies extend forwardly at each junction of the chords formed by the patch panels. Moreover, as these three-ply areas converge toward the clew grommet, the number of plies increases until there is a five-ply thickness at the grommet 35. It would appear, therefore, that outwardly divergent but diminishing thickness of plies more equally distribute the strain load than prior art reinforcements.

It is to be understood, therefore, that this invention is not limited to the particular embodiment disclosed for purposes of exemplification. The number and length of patch panels may vary; two may be sufficient for relatively small or light-weight sails intended for small boats or very light wind; in very large sails, particularly for heavy boats intended for beating or close-reaching in strong winds, seven or more may be required. It has been found empirically that, when (as is usually the case) the fabric of the patch panels is of the same fiber, weave, and weight as the sail panels, the length (in inches) of a patch panel should be numerically more than twice the square root of the length (in feet) of the luff of the sail, with five or six times that square root of the length of the luff a practical median length (in inches), with lengths beyond eight or nine times that square root approaching, if not exceeding, the law of diminishing returns for practical advantages.

Reinforcing patches made according to this invention are most useful for reinforcing clews, but are also useful for reinforcing the tacks of sails, particularly genoa jibs. This is not intended to exclude such reinforcements from the heads of sails, but they will usually be applied the least to that corner, due to the relatively narrow angle in mainsails and jibs, the reinforcement provided by head boards in mainsails, and the relative absence of strain wrinkles at the heads of other sails that are well-cut. All patch panels need not be sewn together on one side of a sail panel (or panels) but may be staggered alternately on opposite sides so that the sail panel is reinforced on both sides, but this variation usually increases labor time and costs. The outward ends of the fanned patch panels need not be straight lines but may be curved so that the outward end of the patch appears as an arc, for example, but this variation also increases labor and cutting costs; lines near the end of and perpendicular to the center lines of the divergent patch panels so modified will still constitute contiguous chords of an arc from the foot to the leech.

This invention is, therefore, subject to modifications of and variations from the specific embodiment disclosed by those skilled in the art without departure from the scope of the invention as defined in the appended claims.

What is claimed is:

1. A reinforcement for the corner of a sail fabricated from a plurality of substantially rectangular patch panels attached in an overlying position to each other and the sail adjacent the point of maximum strain at the reinforced corner thereof, said patch panels fanning outwardly from each other from said point so that, for at least the majority of the length of each panel, it overlaps an adjacent panel, the edges of said fanned out patch panels within the corner of the sail being sewn to said sail and the outwardly fanned-out ends thereof being substantially contiguous to form substantially successive chords of an arc substantially centered at said point.

2. A sail reinforcement as defined in claim 1 in which, from said area of maximum strain and point of attachment, said patch panels are of substantially equal length and the outer ends of said patch panels are contiguous to form successive and substantially equal approximations of chords of an arc centered adjacent said point of maximum strain and extending from one edge of said corner to the other edge.

3. A sail reinforcement as defined in claim 2 in which, at the juncture of the outer ends of the panel patches there are formed the outer apices of at least three-ply areas extending toward said area of maximum strain.

4. A sail reinforcement as defined in claim 3 in which the number of sail patches are such that three or more plies are located at the area of maximum strain and all said plies are then secured together by a grommet means.

5. A sail reinforcement as defined in claim 4 in which the length (in inches) of a patch panel is numerically more than twice the square root of the length (in feet)

of the luff of the sail.

6. A sail reinforcement as defined in claim 5 in which the reinforced corner is the clew of the sail.

7. A sail reinforcement as defined in claim 5 in which the reinforced corner is the tack of the sail.

8. The method of reinforcing the corner of a sail comprising stacking a plurality of patch panels comprised of substantially rectangular lengths of sail cloth cut substantially to the run-of-the-goods, securing said stack at one end to provide a pivot point for said lengths, fanning said lengths about said pivot point so that, for at least the majority of the length of each panel, it overlaps an adjacent panel and until the other ends are nearly contiguous at opposite sides to form successive chords of an arc substantially centered on said pivot point, locating said pivot point in the area of maximum strain at the corner of a sail, and joining together the edges of said fanned patch panel to each other and to at least one panel of said sail within the corners thereof.

9. The method of reinforcing the corner of a sail as defined in claim 8 including the step of trimming the fanned rectangular patch panels extending beyond the area intended for the sail corner and sufficiently within said area to permit the forming of tablings to the corner being reinforced.

10. The method as defined in claim 9 including the step of providing a grommet extending through said sail and the fanned patch panels in the general area of maximum strain at the corner of the sail.

* * * * *